United States Patent [19]

Dooley

[11] 4,241,386

[45] Dec. 23, 1980

[54] FLUORESCENT LAMP ADAPTER FOR RESIDENTIAL INCANDESCENT-TYPE LAMP FIXTURE

[75] Inventor: Thomas E. Dooley, Clifton, N.J.

[73] Assignee: Westinghouse Electric Corp., Pittsburgh, Pa.

[21] Appl. No.: 32,798

[22] Filed: Apr. 24, 1979

[51] Int. Cl.[3] ..... F21V 23/00; F21V 23/02

[52] U.S. Cl. ..... 362/216; 362/221; 362/225; 362/249; 362/417

[58] Field of Search ..... 362/216, 221, 225, 224, 362/249, 370, 371, 378, 417, 426, 432

[56] References Cited

U.S. PATENT DOCUMENTS

| | | | |
|---|---|---|---|
| 443,521 | 12/1890 | Hipwell | 362/417 |
| 2,450,302 | 9/1948 | Rowe | 362/216 |
| 2,697,777 | 12/1954 | Rosa | 362/216 |
| 2,769,083 | 10/1956 | Archer | 362/216 |
| 2,817,004 | 12/1957 | Baumgartner | 362/216 |
| 2,830,171 | 4/1958 | Buck | 362/370 |
| 2,963,255 | 12/1960 | Bobrick | 362/371 |
| 2,963,574 | 12/1960 | Pfatt | 362/216 |
| 4,004,144 | 1/1977 | Chako | 362/221 |
| 4,161,020 | 7/1979 | Miller | 362/225 |

OTHER PUBLICATIONS

Dale, Ulrich, and Morris, "Conversion of Incandescent Lamp Sockets to Flourescent in the Home Market", *Lighting Design & Application,* Mar. 1976.

*Primary Examiner*—Stephen C. Bentley
*Assistant Examiner*—Edward F. Miles
*Attorney, Agent, or Firm*—R. S. Lombard

[57] ABSTRACT

A fluorescent lamp adapter for use in combination with a residential incandescent-type lamp fixture wherein the fixture includes an elongated fixture body supported in generally vertical disposition and having electrical conductors associated therewith. The fixture also includes an incandescent-lamp-type socket vertically projecting from the upper portion of the fixture body and operatively receiving the electrical conductors and a lampshade-supporting harp. The fluorescent lamp adapter comprises a housing conformed to fit into the space defined by the harp above the socket, supporting means adapted for affixing the housing to the harp, lamp mounting means affixed to the housing for engaging and supporting two annular-shaped tubular fluorescent lamps within a lampshade and on opposite sides of the vertical plane defined by the harp. The axes of the lamps as mounted are secured substantially horizontal and substantially colinear.

4 Claims, 6 Drawing Figures

FLUORESCENT LAMP ADAPTER FOR RESIDENTIAL INCANDESCENT-TYPE LAMP FIXTURE

BACKGROUND OF THE INVENTION

This invention relates to fluorescent lamp adapters and, in particular, to a fluorescent lamp adapter for a residential incandescent-type lamp fixture.

It is well known that a fluorescent lamp lighting system is more efficient than an incandescent lamp lighting system by a factor of 3 to 4 or more for equivalent illumination. In the past, however, fluorescent lamps have not been used to any appreciable degree for indoor residential lighting because of their poor color rendering properties, as compared to incandescent lighting. In recent years, though, fluorescent lamps are available with both a high luminous output and a color appearance and color rendition comparable to incandescent. A number of adapters have been disclosed to convert residential incandescent lighting fixtures to fluorescent.

One such adapter is disclosed in U.S. Pat. No. 2,817,004 dated Dec. 17, 1957 issued to Baumgartner et al. This patent discloses a combined adapter and holder for circular tubular fluorescent lamps. The combined adapter and holder are mountable on existing light fixtures designed for incandescent lamps equipped with screw-type bases and with the plane of the circular lamp envelope being essentially vertical.

Another such lamp adapter is disclosed in U.S. Pat. No. 2,697,777 dated Dec. 21, 1954, issued to Ercole Rosa. This patent describes a lamp adapter comprising a body including a first section and a second section, a circumferential ring on the body is secured to the first section and second section, securing the first section to the second section. A plurality of circumferentially spaced grooves in the body and a plurality of brackets are included, the brackets have hook portions detachably engaged in the grooves between the ring and the body. The brackets have arcuate free-end portions adapted to support a circular fluorescent lamp.

In an Article appearing in *Lighting Design and Application,* March 1976 edition, entitled "Conversion of Incandescent Lamp Sockets to Fluorescent in the Home Market" by E. A. Dale, a retrofit lighting system for converting incandescent fixtures to fluorescent is described. In FIG. 5 of the Article is shown a solid-state ballast mounted within the periphery of the harp of a table lamp. A circular tubular fluorescent lamp is supported in a horizontal orientation around the harp.

SUMMARY OF THE INVENTION

This invention comprises a fluorescent lamp adapter means for use in combination with a residential incandescent-type lamp fixture. The residential incandescent-type lamp fixture comprises an elongated fixture body supported in generally vertical disposition and having electrical conductors associated therewith. An incandescent-type lamp socket means projects vertically from the upper portion of the fixture body and operatively receives the electrical conductors. A lampshade-supporting harp means is included, comprising two elongated members affixed to and supported by the fixture body proximate the upper portion thereof and projecting upwardly in a vertical plane and on opposite sides of the socket means, first to separate and then to return and meet at a location generally directly above the socket means. The incandescent-type lamp fixture also includes a lampshade of predetermined dimensions adapted to be supported by the harp means from the upper portion thereof.

The fluorescent lamp adapter means comprises housing means conformed and adapted to fit into the space defined by the harp means and above the socket means. The lamp adapter means also includes supporting means adapted for affixing the housing means to the harp means and lamp mounting means affixed to the housing means for engaging and supporting two annular-shaped tubular fluorescent lamps within the lampshade and on opposite sides of the vertical plane defined by the harp means. The axes of the lamps as mounted are substantially horizontal and substantially colinear. Electrical ballast means is provided for the lamps and is retained in the housing. Electrical adapter means is also provided connecting to the ballast means and adapted to connect to the incandescent-lamp-type socket means, and fluorescent lamp socket means associated with the annular fluorescent lamps connect to the ballast means for energizing the lamps.

BRIEF DESCRIPTION OF THE DRAWINGS

For a better understanding of the invention, reference may be had to the accompanying drawings, in which.

BRIEF DESCRIPTION OF THE PREFERRED EMBODIMENTS

Figure 1:
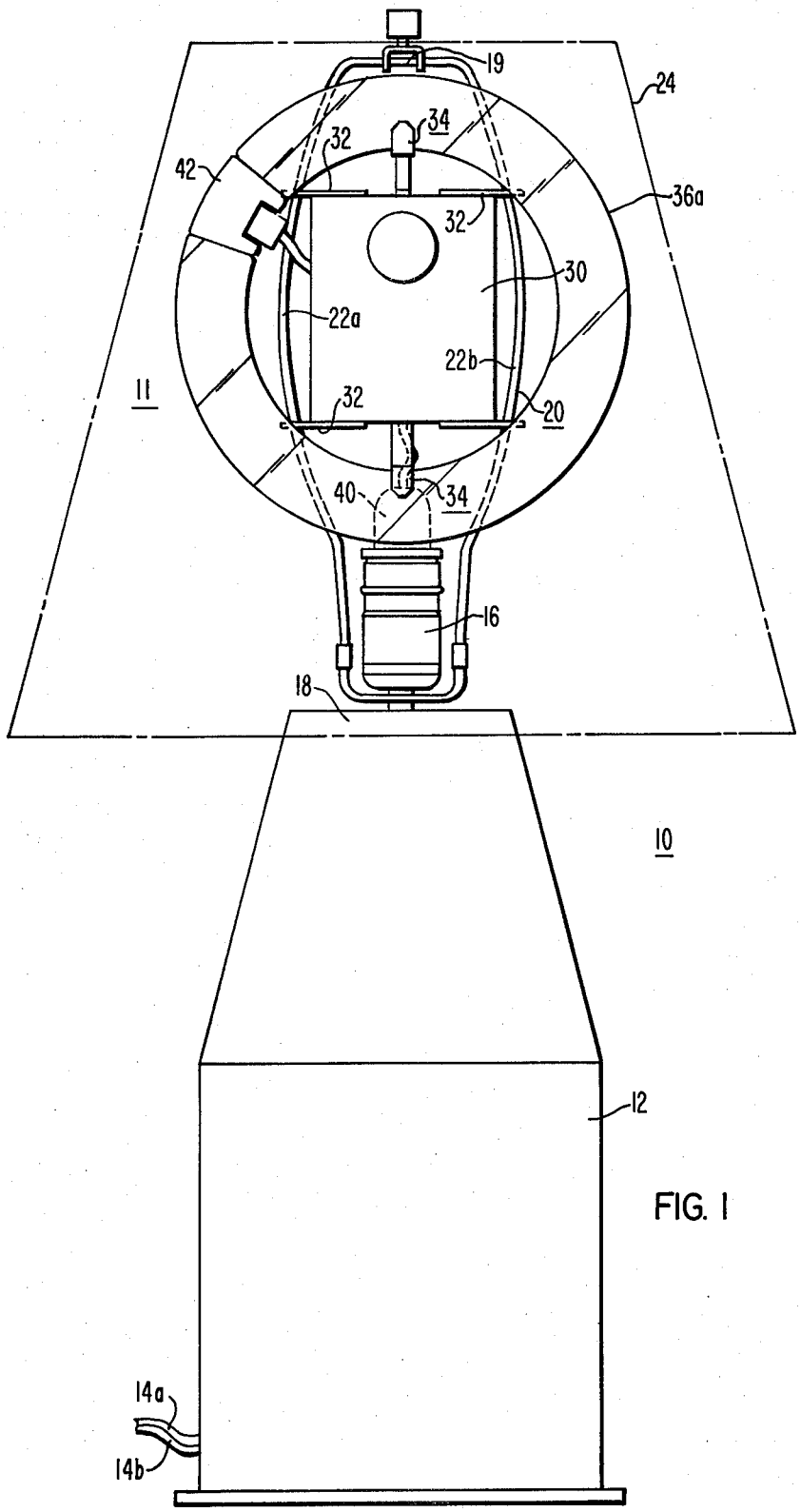
FIG. 1 is an elevational view, partly in section, of a residential incandescent-type fixture including the fluorescent lamp adapter.
Figure 2:
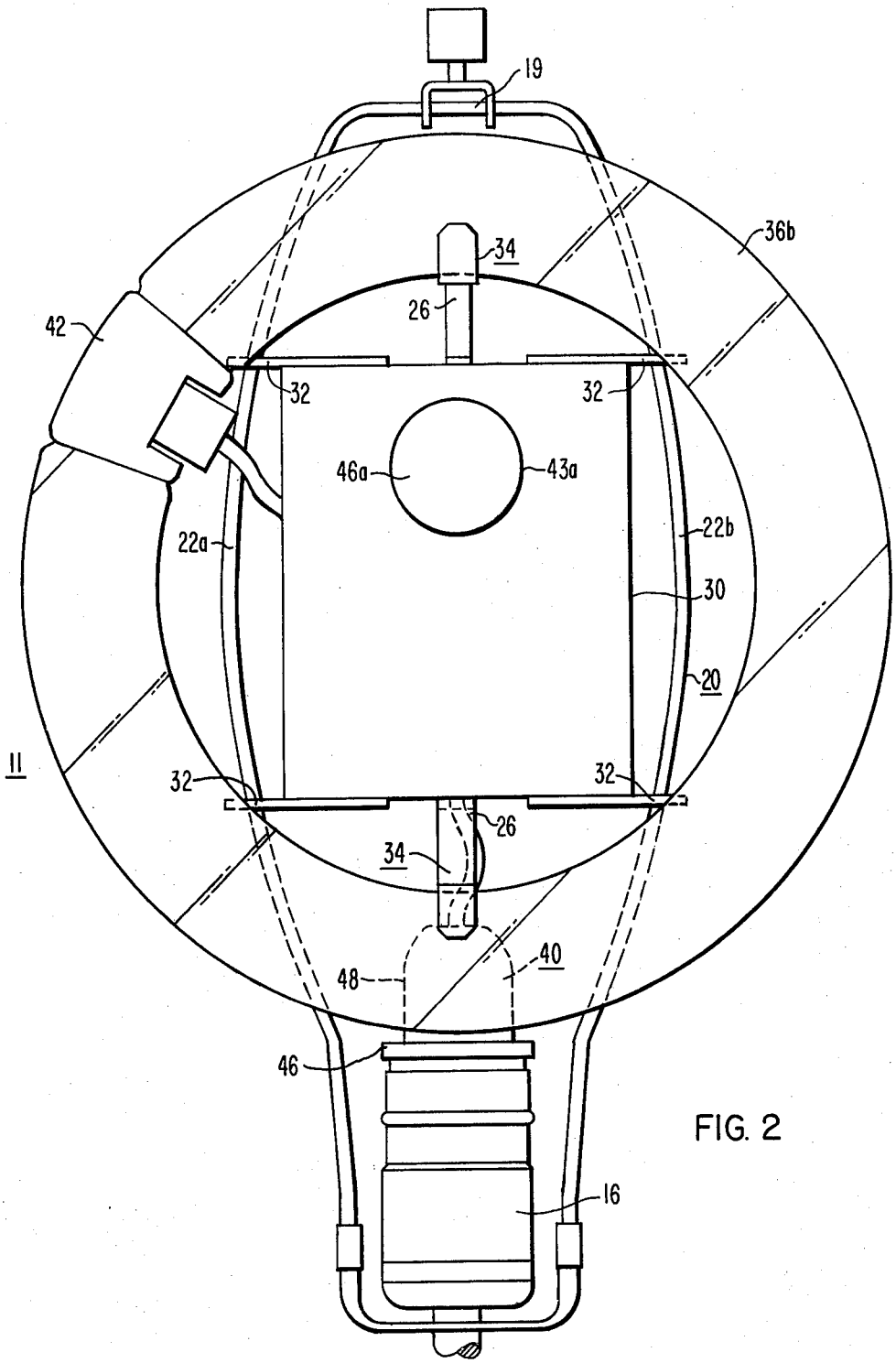
FIG. 2 is an enlarged, fragmentary elevational view partly in section showing the portion of the residential incandescent-type fixture that includes the fluorescent lamp adapter.
Figure 3:
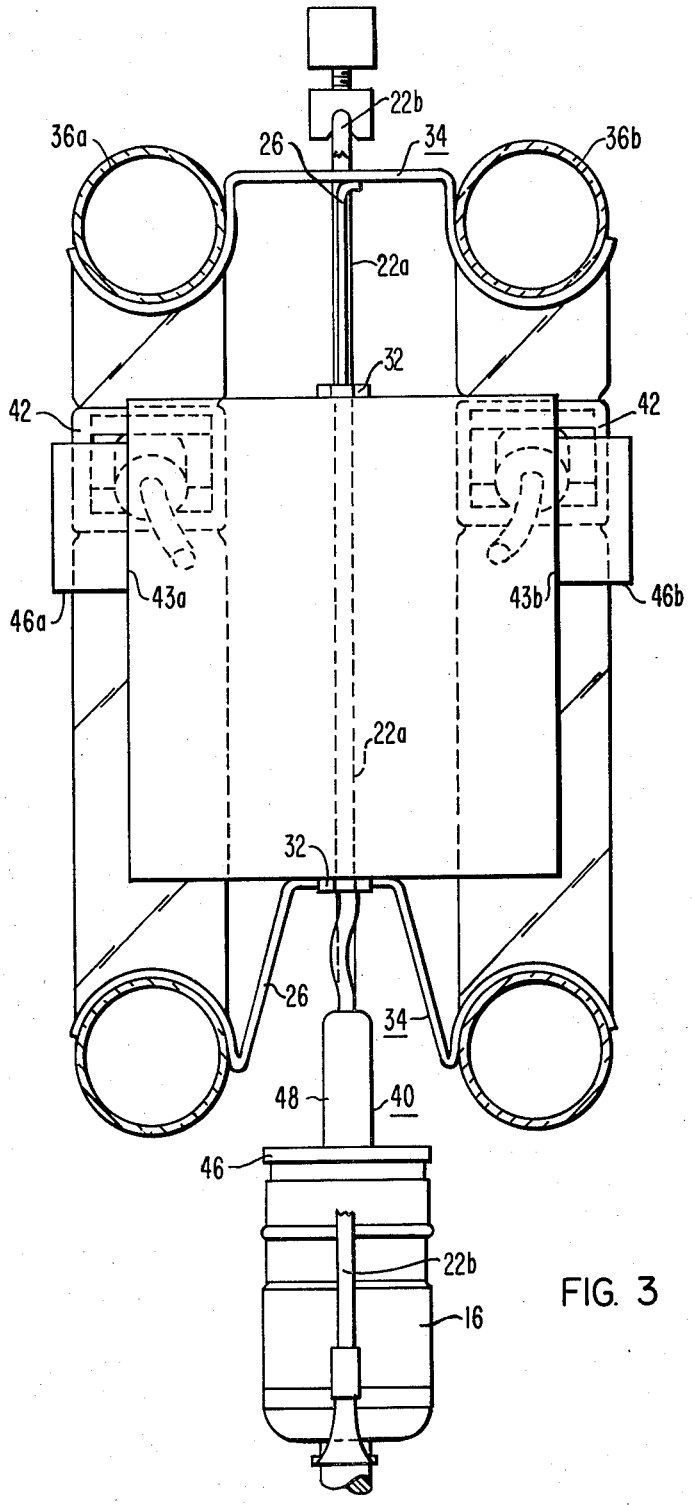
FIG. 3 is a sectional side view of the harp and adapter portion of the embodiment as shown in FIG. 2, taken on the line III—III in FIG. 2.

Referring to FIGS. 1–3, there is shown a residential incandescent-type lamp fixture 10 for use in combination with a typical fluorescent lamp adapter means 11. The fixture 10 comprises an elongated fixture body 12 supported in generally vertical disposition and having electrical conductors 14*a*, 14*b* associated therewith. The fixture 10 also comprises an incandescent-lamp-type socket means 16 vertically projecting from the upper portion 18 of the fixture body 12 and operatively receiving said electrical conductors 14*a*, 14*b*. The fixture 10 further comprises lampshade-supporting harp means 20 comprising two elongated members 22*a*, 22*b* affixed to and supported by the fixture body 12 proximate the upper portion 18 thereof and projecting upwardly in a vertical plane and on opposite sides of the socket means 16, first to separate and then to return and meet at a location 19 generally directly above the socket means. The fixture further comprises a lampshade 24 of predetermined dimensions adapted to be supported by the harp means 20 from the upper portion 26 thereof. The residential incandescent-type lamp fixture 10 as described thus far is generally conventional.

Figure 4:
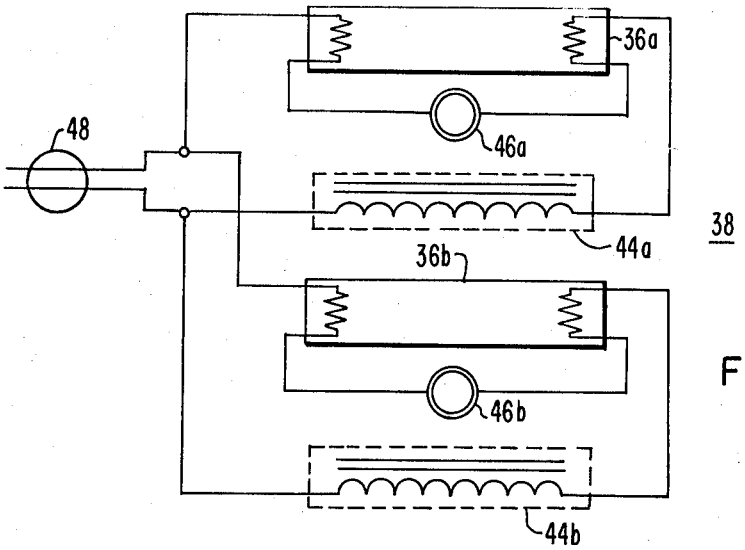
FIG. 4 is a schematic diagram of a typical electrical ballast means.

The fluorescent lamp adapter means 11 comprises housing means 30 conformed and adapted to fit into the space defined by the harp means 20 and above the socket means 16. The lamp adapter means 11 also comprises supporting means 32 for affixing the housing means 30 to the harp means 20 and lamp securing means 34 affixed to the housing means 30 for engaging and supporting two annular-shaped tubular fluorescent lamps 36*a*, 36*b* within the lampshade 24 and on opposite sides of the vertical plane in which the harp means 20 lies. The axes of the lamps 36*a*, 36*b* as secured are substantially horizontal and substantially colinear. The retrofit fluorescent lamp adapter means 28 further comprises electrical ballast means 38 having a conventional circuit as shown in FIG. 4. The electrical ballast means 38 is mounted in the housing means 30. The fluorescent lamp adapter means 28 further comprises electrical adapter means 40 connecting the ballast means 38 to the incandescent-lamp-type socket means 16 and, fluorescent lamp socket means 42 associated with the annular tubular lamps 36*a*, 36*b* and connecting to the ballast means 38 for energizing the lamps 36*a*, 36*b*.

In practicing the invention, the fluorescent lamp adapter means 28 was constructed using housing means 30 made of a metallic box-like member, aluminum being preferred, having dimensions 3 in. × 3 in. × 4 in. and two apertures 43*a*, 43*b* provided therein on opposite sides thereof as shown in FIGS. 1–3. Referring to FIG. 4 for details of the electrical circuit of the ballast means, the housing means 30 encloses two conventional choke ballasts 44*a*, 44*b*, two starter sockets and associated wiring. Each of the starter sockets are mounted inside the housing 30 and aligned with one of the apertures 43*a*, 43*b* to receive glow-starters 46*a*, 46*b*. The supporting means 32 includes four forked brackets as shown in FIGS. 1–3. This configuration provides rigid support for the housing 30. It has been found desirable to support the housing 30 without direct connection to the socket means 16 because of the possible shock hazard that may result. The electrical adapter means 40 includes a screw base plug which is screwed into the socket means 18 which is a standard screw-type metallic socket. The electrical adapter means 40 also includes two-conductor wire connecting the ballast means 38 to a two-prong plug 48 which is plugged into the screw base plug 46.

Two 22 watt annular-shaped tubular fluorescent lamps 36*a*, 36*b* having an outside diameter of 8¼ inches are held in a vertical position as shown in FIGS. 1–3 by the lamp securing means 34, which are spring-clip lamp brackets, two for each lamp. These brackets 26 are affixed to the housing 30 as shown, thereby eliminating any interference with the lampshade.

Figure 5:
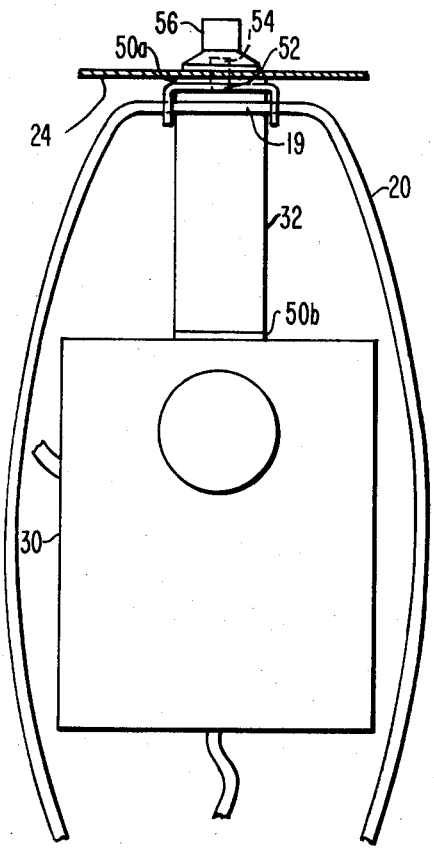
FIG. 5 is a fragmentary elevational view showing an alternative mounting arrangement for the fluorescent lamp adapter.
Figure 6:
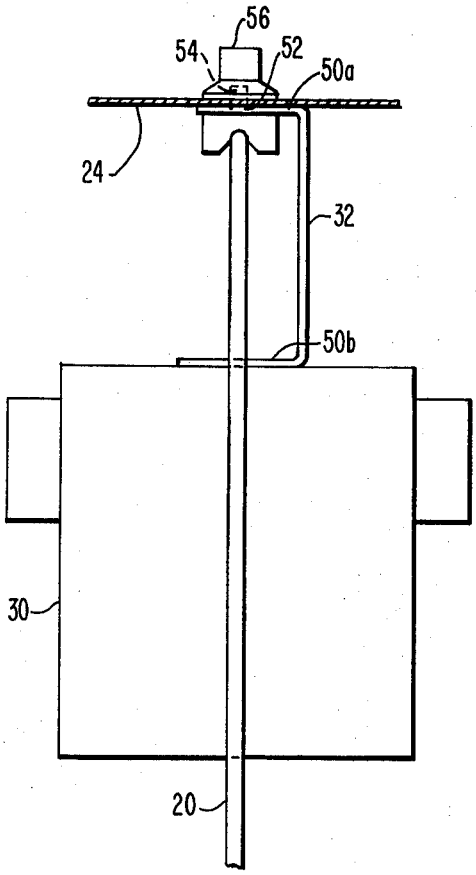
FIG. 6 is a side view of the embodiment as shown in FIG. 5.

An alternative embodiment of the invention is shown in FIGS. 5 and 6. The supporting means 32 in this embodiment comprises a U-shaped bracket member comprising two side members 50*a*, 50*b*. One side 50*a* of the U-shaped bracket 32 is adapted to be affixed to the harp means 20 at the point where the two elongated members 22*a*, 22*b* of the harp means 20 meet at the location 19 generally directly above the socket means 16 and the other side 50*b* of the U-shaped bracket member 32 is affixed to the housing means 30. In the construction of the U-shaped bracket 32, the bracket is provided with an aperture 52 to receive a screw member 54 that is conventionally included at location 19 as part of a fixture. A nut 56 that is also conventionally included as part of a fixture is screwed onto the screw member 54 thereby securing the one side 50*a* of the U-shaped bracket member 32 and lampshade 24 in place. The other side 50*b* of the U-shaped bracket member 22 is affixed to housing 30 by welding a portion of the outer surface of the other side 50*b* of the U-shaped bracket to the housing means. This configuration eliminates any dependence on the shape of the harp 20 for mounting the housing 30.

I claim:

1. A fluorescent lamp adapter for use in combination with a residential incandescent-type lamp fixture, said fixture comprising an elongated fixture body supported in generally vertical disposition and having electrical conductors associated therewith, an incandescent-lamp-type socket means vertically projecting from the upper portion of said fixture body and operatively receiving said electrical conductors, a lampshade-supporting harp means comprising two elongated members affixed to and supported by said fixture body proximate the upper portion thereof and projecting upwardly in a vertical plane and on opposite sides of said socket means, first to separate and then to return and meet at a location generally directly above said socket means, and a lampshade of predetermined dimensions adapted to be supported by said harp means from the upper portion thereof, said fluorescent lamp adapter comprising:

housing means conformed and adapted to fit into the space defined by said harp means and above said socket means, supporting means adapted for affixing said housing means to said harp means, lamp mounting means affixed to said housing means for engaging and supporting two annular-shaped tubular fluorescent lamps within said lampshade and on opposite sides of the vertical plane defined by said harp means, the axes of said lamps as mounted being substantially horizontal and substantially colinear, electrical ballast means for said lamps retained in said housing means, electrical adapter means connecting said ballast means and adapted to connect to said incandescent-lamp-type socket means, and fluorescent lamp socket means associated with said annular fluorescent lamps and connecting to said ballast means for energizing said lamps.

2. The fluorescent lamp adapter of claim 1, wherein said housing means is metallic and box-like.

3. The fluorescent lamp adapter of claim 1, wherein said supporting means comprises four forked brackets.

4. The fluorescent lamp adapter of claim 1, wherein said supporting means comprises a U-shaped bracket member comprising two side members connected by a support member, one of said sides of said U-shaped bracket adapted to be affixed to said harp means at the point where said two elongated members of said harp means meet at said location generally directly above said socket means, said other side of said U-shaped bracket affixed to said housing means.

* * * * *